US011390111B2

(12) United States Patent
Iwahara

(10) Patent No.: US 11,390,111 B2
(45) Date of Patent: Jul. 19, 2022

(54) WRITING IMPLEMENT

(71) Applicant: KABUSHIKI KAISHA PILOT CORPORATION, Tokyo-to (JP)

(72) Inventor: Takashi Iwahara, Tokyo-to (JP)

(73) Assignee: KABUSHIKI KAISHA PILOT CORPORATION, Tokyo (JP)

( * ) Notice: Subject to any disclaimer, the term of this patent is extended or adjusted under 35 U.S.C. 154(b) by 58 days.

(21) Appl. No.: 16/957,545

(22) PCT Filed: Dec. 5, 2018

(86) PCT No.: PCT/JP2018/044700
§ 371 (c)(1),
(2) Date: Jun. 24, 2020

(87) PCT Pub. No.: WO2019/131020
PCT Pub. Date: Jul. 4, 2019

(65) Prior Publication Data

US 2021/0362535 A1 Nov. 25, 2021

(30) Foreign Application Priority Data

Dec. 28, 2017 (JP) ..... JP2017-254755

(51) Int. Cl.
*B43K 24/08* (2006.01)
*B43K 5/00* (2006.01)
(Continued)

(52) U.S. Cl.
CPC ..... *B43K 24/08* (2013.01); *B43K 5/005* (2013.01); *B43K 5/16* (2013.01); *B43K 24/06* (2013.01)

(58) Field of Classification Search
CPC ..... B43K 24/00; B43K 24/02; B43K 24/04; B43K 24/06; B43K 24/08; B43K 5/005; B43K 5/16
(Continued)

(56) References Cited

U.S. PATENT DOCUMENTS 780,416 A * 1/1905 Eberstein
8,128,301 B2 * 3/2012 Rolion ..... B43K 7/12 401/116
(Continued)

FOREIGN PATENT DOCUMENTS

CN 203210929 9/2013
CN 104781086 7/2015
(Continued)

OTHER PUBLICATIONS

Extended European Search Report dated Aug. 2, 2021 in corresponding European Patent Application No. 18896247.6.
(Continued)

*Primary Examiner* — David J Walczak
(74) *Attorney, Agent, or Firm* — Wenderoth, Lind & Ponack, L.L.P.

(57) ABSTRACT

A writing implement includes: a barrel; a writing body supported by the barrel so as to be relatively movable with respect to the barrel in an axial direction thereof, whereby the writing body is projected from and retracted into a front end of the barrel; a rotation member disposed in the barrel so as to be relatively rotatable with respect to the barrel about an axis thereof, the rotation member being provided with a groove or a slit that helically extends about the axis; and a pressing unit having a moving unit that moves in the groove or the slit, the pressing unit being relatively movable with respect to the barrel in the axial direction, while its relative rotation about the axis being restricted; wherein the
(Continued)

pressing unit can be pressed forward with respect to the barrel.

5 Claims, 9 Drawing Sheets

(51) Int. Cl.
*B43K 5/16* (2006.01)
*B43K 24/06* (2006.01)

(58) Field of Classification Search
USPC ..... 401/109–113, 116
See application file for complete search history.

(56) References Cited

U.S. PATENT DOCUMENTS

| | | | | |
|---|---|---|---|---|
| 2006/0144565 | A1 | 7/2006 | Tsai et al. | |
| 2008/0131189 | A1 | 6/2008 | Yoon | |
| 2013/0318761 | A1 | 12/2013 | Shim | |
| 2014/0270894 | A1* | 9/2014 | Wu | G06F 3/041 401/116 |

FOREIGN PATENT DOCUMENTS

| | | |
|---|---|---|
| EP | 0 402 558 | 12/1990 |
| JP | 63-191697 | 8/1988 |
| JP | 6-262896 | 9/1994 |
| JP | 8-164699 | 6/1996 |
| JP | 2007-320209 | 12/2007 |
| JP | 2011-156826 | 8/2011 |
| JP | 2014-91268 | 5/2014 |

OTHER PUBLICATIONS

International Search Report dated Feb. 19, 2019 in corresponding International Application No. PCT/JP2018/044700.
International Preliminary Report on Patentability dated Jun. 30, 2020 in International (PCT) Application No. PCT/JP2018/044700.
Office Action dated Jan. 5, 2021 in corresponding Chinese Patent Application No. 201880083775.6 with English-language translation.
Office Action dated Sep. 17, 2021 in corresponding Japanese Patent Application No. 2017-254755, with Machine English Translation, 11 pages.
Office Action dated Sep. 3, 2021 in corresponding Japanese Patent Application No. 2020-198796, with English Machine Translation, 7 pages.

* cited by examiner

WRITING IMPLEMENT

FIELD OF THE INVENTION

The present invention relates to a writing implement.

BACKGROUND ART

A rotation-type writing implement in which a head crown is rotated with respect to a barrel about an axis of the barrel so as to project/retract a writing body supported in the barrel from/into a front end opening of the barrel has been conventionally known (JP2007-320209A). Since a smooth projecting/retracting motion can be realized by decreasing a frictional resistance of an inside rotation mechanism, such a writing implement has excellent operation feeling. On the other hand, the writing body of a rotation-type writing implement is projected/retracted generally by, while holding the barrel by one hand, holding the head crown by the other hand and by relatively rotating the head crown with respect to the barrel about the axis. Thus, a quick projecting/retracting operation is difficult, and it takes time for the projecting/retracting operation. Thus, there is a room for improving operability.

On the other hand, a knock-type writing implement in which, by pushing forward a knock member which projects outside from a rear end opening of the barrel, with respect to a barrel, for example, a writing body supported in the barrel is projected from and retracted into a front end opening of the barrel. Since the projecting/retracting operation can be performed by one hand, the knock-type writing implement can be quickly operated. However, since the writing body is retracted into the barrel with momentum, the writing body may experience a large impact. In addition, click-clack noises may occur upon knocking. Thus, there is a room for improving operation feeling.

SUMMARY OF THE INVENTION

The present invention has been made in view of the above circumstances. Namely, the object of the present invention is to provide a writing implement excellent in both operability and operation feeling.

A writing implement according to the present invention comprises:

a barrel;

a writing body supported by the barrel so as to be relatively movable with respect to the barrel in an axial direction thereof, whereby the writing body is projected from and retracted into a front end of the barrel;

a rotation member disposed in the barrel so as to be relatively rotatable with respect to the barrel about an axis thereof, the rotation member being provided with a groove or a slit that helically extends about the axis; and a pressing unit having a moving unit that moves in the groove or the slit, the pressing unit being relatively movable with respect to the barrel in the axial direction, while its relative rotation about the axis being restricted;

wherein the pressing unit can be pressed with respect to the barrel, from outside the barrel.

The rotation member can be rotated from outside the barrel;

when the rotation member is relatively rotated with respect to the barrel about the axis, the moving unit of the pressing unit may be relatively moved with respect to the barrel in the axial direction; and when the pressing unit is pressed forward with respect to the barrel, the rotation member may be relatively rotated with respect to the barrel about the axis.

The above writing implement may further comprise a braking unit that decelerates a rotation speed of the rotation member when the rotation member relatively rotates with respect to the barrel about the axis.

Alternatively, the above writing implement may further comprises a braking unit having a contact member that is in contact with the rotation member, and urging means that urges the contact member with respect to the barrel in the axial direction so as to bear the contact member against the rotation member.

In addition, the urging means may be disposed in front of the rotation member so as to bear the contact member against the rotation member from the front side.

In the above writing implement, the rotation member may have a front wall and a rear wall which extend opposite to each other so as to define the groove or the slit; and the front wall may have a bulge, which bulges rearward, near a front end of the groove or the slit.

Since the present invention enables a simple projecting/retracting operation by one hand and a quiet and smooth projecting/retracting operation, a writing implement excellent both in operability and operation feeling can be provided.

DETAILED DESCRIPTION OF THE INVENTION

One embodiment of the present invention is described in detail below, with reference to the attached drawings.

Figure 1:
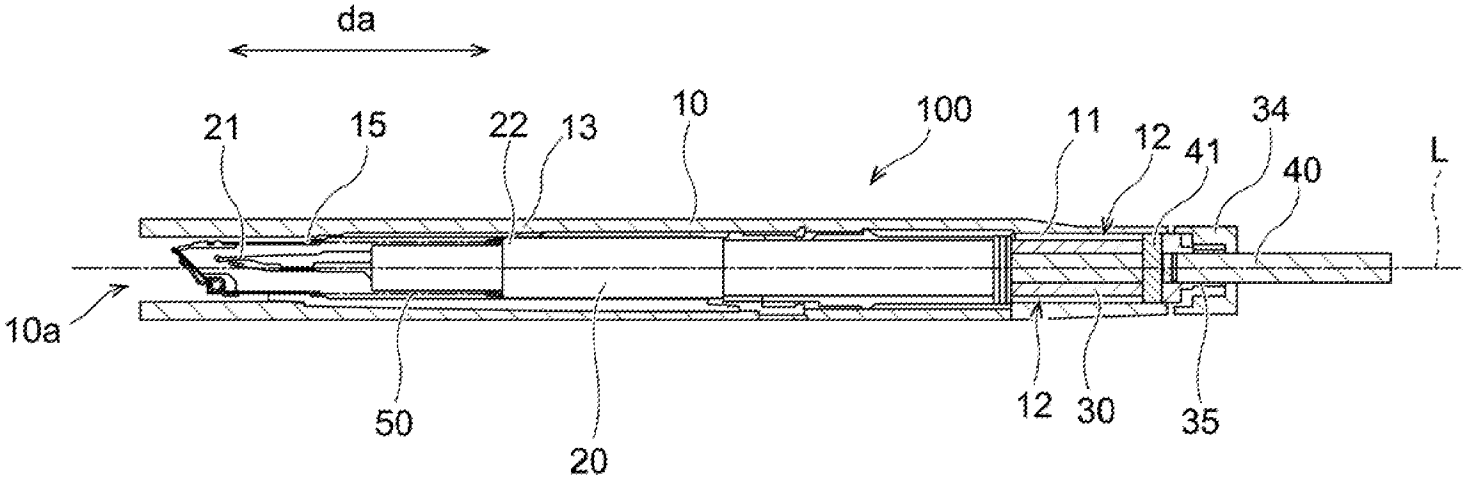
FIG. 1 is a schematic longitudinal sectional view showing a writing implement according to one embodiment of the present invention.
Figure 2:
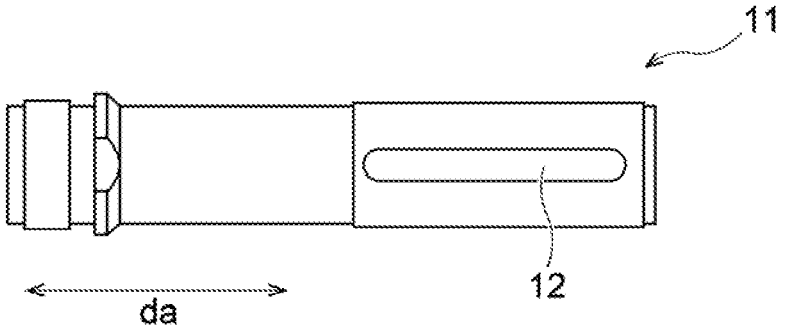
FIG. 2 is a schematic elevational view showing an inner tube of the writing implement of FIG. 1.
Figure 3:
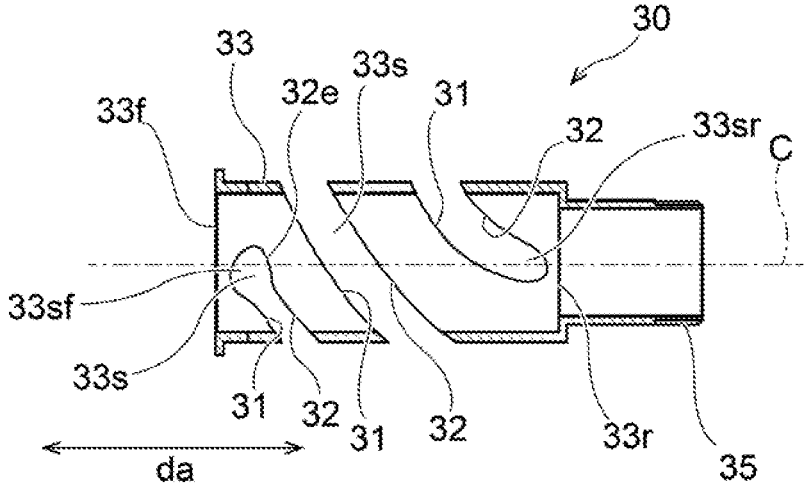
FIG. 3 is a schematic longitudinal sectional view showing a rotation member of the writing implement of FIG. 1.
Figure 4:
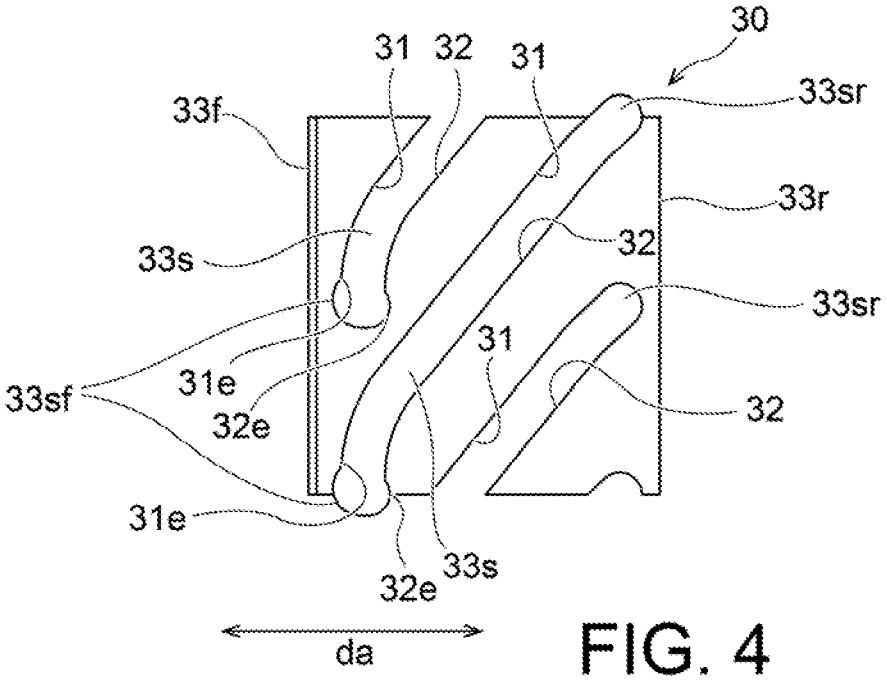
FIG. 4 is a schematic developed view of the rotation member, which is cut along the line C of FIG. 3.

FIG. 1 is a schematic longitudinal sectional view showing a writing implement 100 according to one embodiment of the present invention. Note that a writing body 20 is shown in a side view. In addition, FIG. 2 is a schematic elevational view showing an inner tube 11 of the writing implement 100 of FIG. 1. FIG. 3 is a schematic longitudinal view of a rotation member 30 of the writing implement 100 of FIG. 1. FIG. 4 is a schematic developed view showing the rotation member 30, which is cut along the line C of FIG. 3.

As shown in FIGS. 1 and 3, the writing implement 100 has a barrel 10, a writing body 20 supported by the barrel 10, a rotation member 30 disposed in the barrel 10 and provided with a slit 33*s* that helically extends about an axis L, and a pressing unit 40 having a moving unit 41 that moves in the slit 33*s*. In the example shown in FIG. 1, the writing implement 100 is a fountain pen. However, not limited thereto, the writing implement 100 may be various writing implements such as a ball-point pen, a mechanical pencil, a marker, etc. As shown in FIG. 1, the writing body 20 is supported by the barrel 10 so as to be relatively movable with respect to the barrel 10 in an axial direction da thereof. A pen point 21 is configured to be projected from and retracted into an opening 10*a* delimited in a front end of the barrel 10.

As shown in FIG. 1, the barrel 10 has a barrel body 13, and an inside tube 11 disposed inside the barrel body 13. As shown in FIG. 2, a slot 12 extending along the axial direction da is formed in the inside tube 11. FIG. 2 shows the inside shaft 11 of FIG. 1 seen from above. As shown in FIG. 1, the slot 12 has a width capable of accommodating the moving unit 41 of the pressing unit 40, and is symmetrically provided with respect to an axis L.

As shown in FIGS. 3 and 4, the rotation member 30 is a cylindrical member disposed in the barrel 10 so as to be relatively rotatable with respect to the barrel 10 about its axis L. The rotation member 30 has a cylindrical rotation member body 33, a front wall 31, and a rear wall 32. The front wall 31 and the rear wall 32 extend opposite to each other so as to define two slits 33*s*. The two slits 33*s* extend helically about the axis L (see FIG. 1) with a 180° phase difference. As shown in FIG. 4, each slit 33*s* extends forward (left in FIG. 4) from a position near a rear end 33*r* of the rotation member body 33 at a substantially uniform inclination.

Figure 5A:
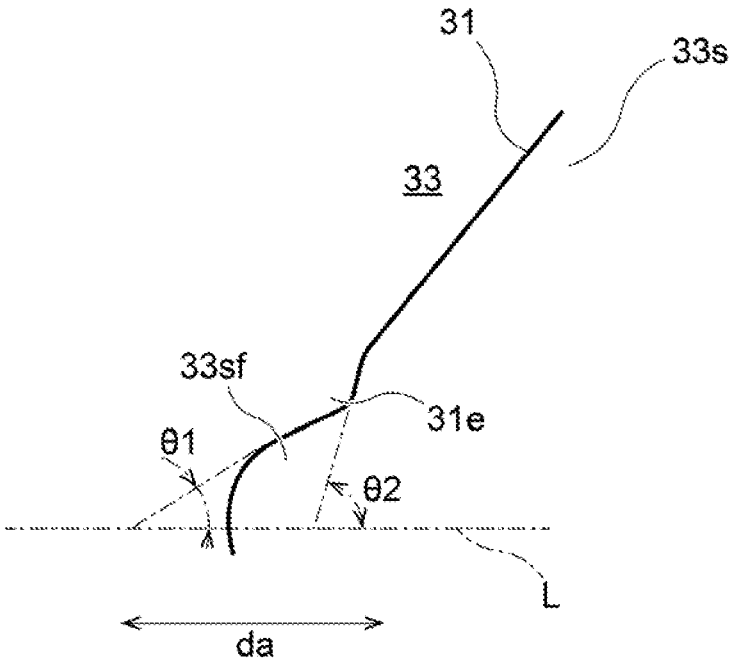
FIG. 5A is an enlarged view showing a part near a front end of a front wall of the rotation member shown in FIG. 3.

On the other hand, the inclination of each slit 33*s* changes at an area near a front end 33*f* of the rotation member body 33. FIG. 5A is an enlarged view showing a part near a front end of the front wall 31 of the slit 33*s* of the rotation member 30 shown in FIG. 3. As shown in FIG. 5A, the front wall 31 has a bulge 31*e*, which bulges rearward (right in FIG. 5A), near a front end 33*sf* of the slit 33*s*. As shown in FIG. 5A, in the bulge 31*e*, when seen from above, the front wall 31 has a shape in which a tangent line and a vector that goes rearward along the axial direction da always define an acute angle ($0° < \theta 1 < \theta 2 < 90°$).

Figure 5B:
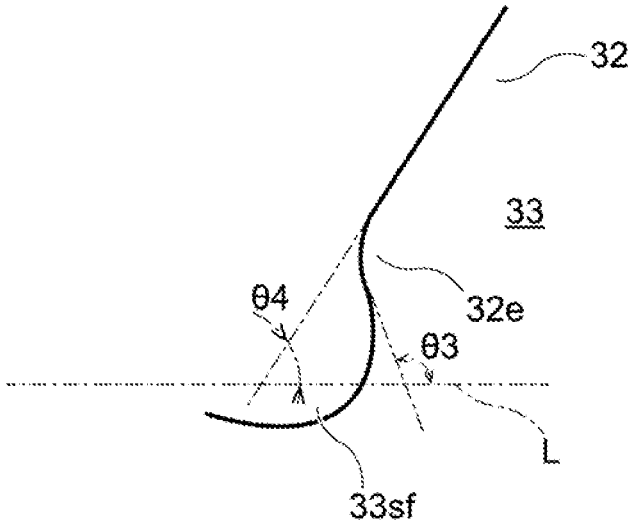
FIG. 5B is an enlarged view showing a part near a front end of a rear wall of the rotation member shown in FIG. 3.

FIG. 5B is an enlarged view showing a part near a front end of the rear wall 32 of the rotation member 30 shown in FIG. 3. As shown in FIG. 5B, a detent portion 32*e* bulging forward is formed near the front end of the rear wall 32 of each slit 33*s*. The rear wall 32 has a shape in which, when seen from above, an angle defined between a tangent line of the rear wall 32 and a vector that goes rearward along the axial direction da changes from an obtuse angle θ3, which is before the detent portion 32*e*, to an acute angle θ4, which is after the detent portion 32*e*.

Returning to FIG. 1, a relative rearward movement of the writing body 20 with respect to the barrel 10 is restricted because a rear end of the writing body 20 is in contact with the pressing unit 40. The writing body 20 is urged rearward with respect to the barrel 10 by a coil spring 50. As illustrated, the coil spring 50 is compressed between a barrel side locking portion 15, which is provided on an inner surface of the barrel body 13, and a writing-body side locking portion 22, which is provided on the writing body 20 behind the barrel side locking portion 15.

As shown in FIG. 1, the pressing unit 40 extends outside from a rear end of the barrel 10 and can be pressed forward from outside the barrel 10. The pressing unit 40 is disposed in the inner tube 11 to pass through the rotation member 30 in the axial direction da and is relatively movable with respect to the barrel 10 in the axial direction da. The moving unit 41 of the pressing unit 40 passes radially through both the two slits 33*s* of the rotation member 30, and both ends thereof are positioned in the slot 12 of the inner tube 11. A rear end portion 35 of the rotation member 30 extends outside from the rear end of the inner tube 11. A head crown 34 is attached to the rear end portion 35. A relative forward movement of the head crown 34 with respect to the inner tube 11 is restricted because the head crown 34 is in contact with the rear end of the inner tube 11. Thus, even when the rotation member 30 is pressed forward by the pressing unit 40, the rotation member 30 does not relatively move forward with respect to the barrel 10 (inner tube 11). Further, although not shown, grease is applied between the pressing unit 40 and the rotation member 30, and between the rotation member 30 and the inner tube 11.

Next, an operation of the above writing implement 100 is described with reference to FIGS. 6A to 6D.

Figure 6A:
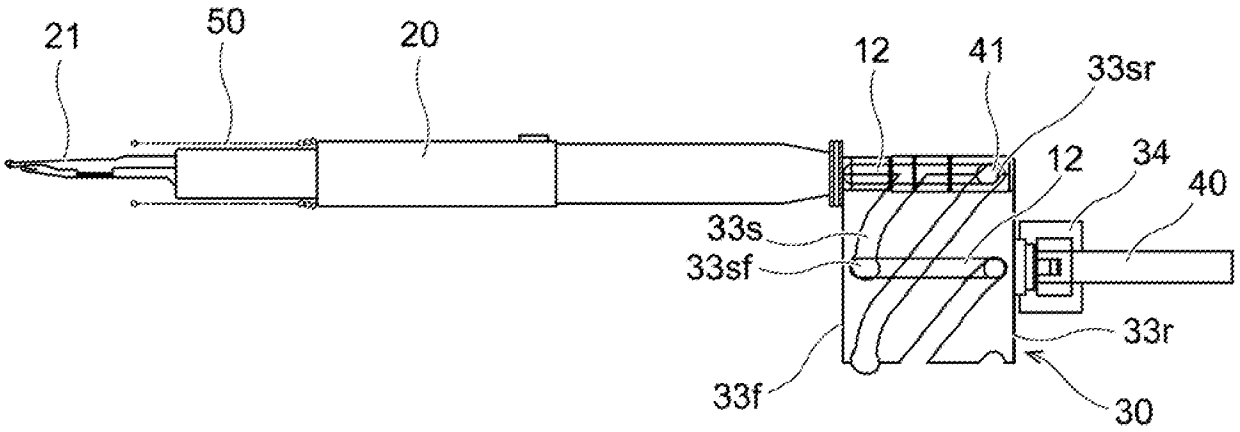
FIG. 6A is a view for describing an operation of the writing implement of FIG. 1, showing a state in which a writing body is retracted in a barrel.
Figure 6B:
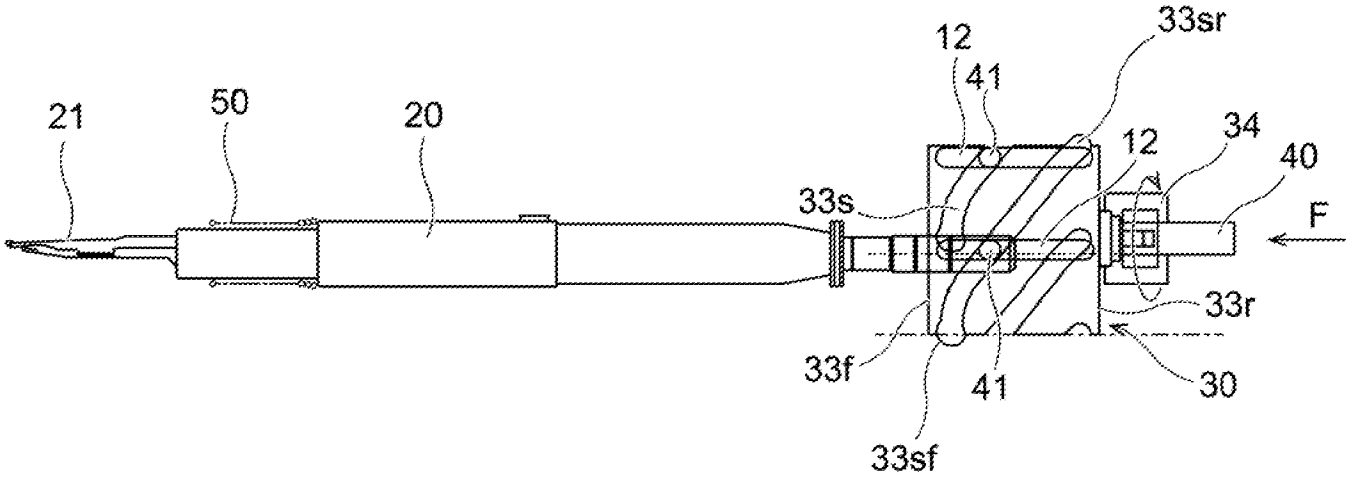
FIG. 6B is a view for describing the operation of the writing implement of FIG. 1, showing a state in which the writing body is relatively moved forward with respect to the barrel.
Figure 6C:
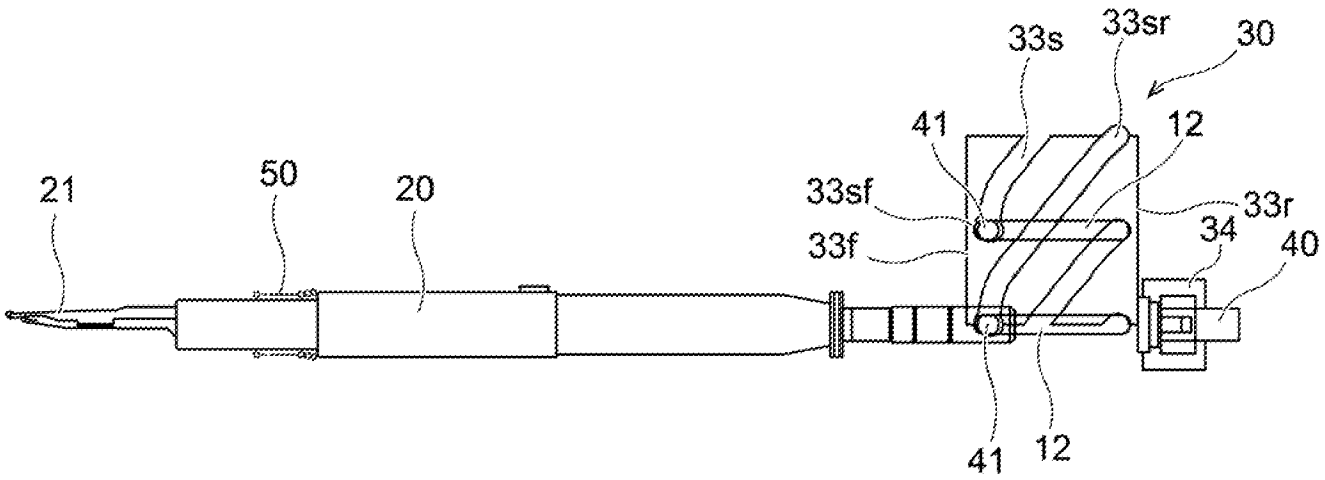
FIG. 6C is a view for describing the operation of the writing implement of FIG. 1, showing a state in which the writing body is projected from the barrel.
Figure 6D:
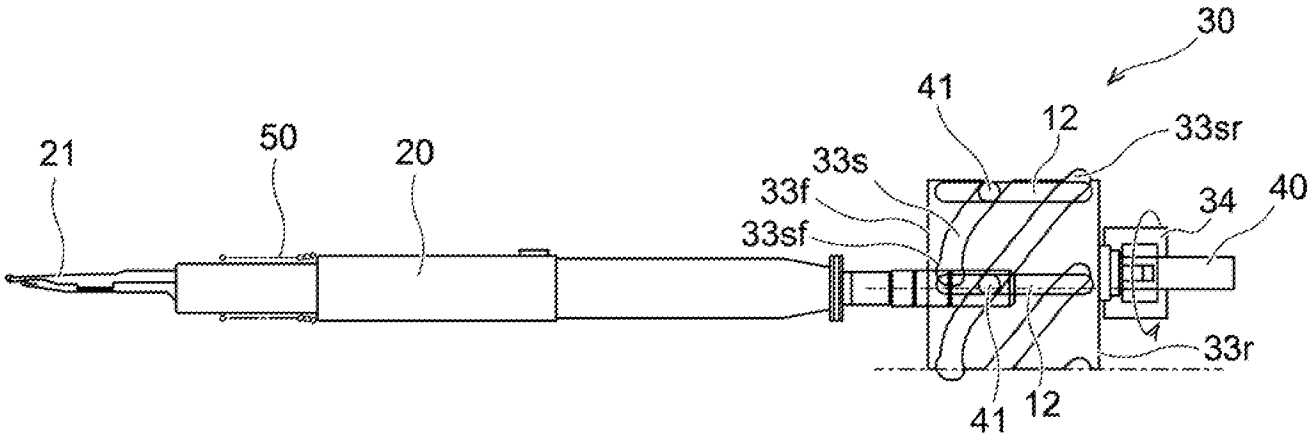
FIG. 6D is a view for describing the operation of the writing implement of FIG. 1, showing a state in which the writing body is relatively moved rearward with respect to the barrel.

FIGS. 6A to 6D are views for describing an operation of the writing implement 100 of FIG. 1. In FIGS. 6A to 6D, the writing body 20, the rotation member 30 and the pressing unit 40 are pulled out from FIG. 1, the rotation member 30 is shown in a developed view, and the position of the slot 12 of the inner shaft 11 is overlapped. FIG. 6A shows a state in which the writing body 20 is retracted in the barrel 10, FIG. 6B shows a state in which the writing body 20 is relatively moved forward with respect to the barrel 10, FIG. 6C shows a state in which the writing body 20 projects from the barrel 10, and FIG. 6D shows a state in which the writing body 20 is relatively moved rearward with respect to the barrel 10.

Herein, as shown in FIG. 6A, the state in which the pen point 21 of the writing body 20 is completely retracted in the barrel 10 is described as an initial state. In this initial state, the moving unit 41 of the pressing unit 40 is positioned at the respective rear ends of the slit 33*s* of the rotation member 30 and the slot 12 of the inner tube 11. This state is maintained by the coil spring 50 which urges rearward the writing body 20 with respect to the barrel 10.

In the writing implement 100, when the pressing unit 40 is moved forward with respect to the barrel 10 with a force F (see FIG. 6B) from the state shown in FIG. 6A, the moving unit 41 presses the front wall 31 of the rotation member 30. Due to this pressing, the front wall 31 and the moving unit 41 are subjected to forces opposed to each other in a direction orthogonal to the inclination of the front wall 31. Thus, these forces include a component in the axial direction da of the barrel 10, and a component in a direction orthogonal to the axial direction da. Since the both ends of the moving unit 41 are positioned in the slot 12 of the inner tube 11, relative rotation of the moving unit 41 with respect to the inner shaft 11 about the axis L is restricted. Thus, as shown in FIG. 6B, the moving unit 41 relatively moves forward along the slot 12, without relatively rotating with respect to the barrel 10. As a result, when seen from behind, the rotation member 30 is relatively rotated clockwise with respect to the barrel 10, and the writing body 20 is relatively moved forward with respect to the barrel 10 while compressing the coil spring 50. In accordance with the relative rotation of the rotation member 30 with respect to the barrel 10, the head crown 34 is relatively rotated with respect to the barrel 10 about the axis L (see FIG. 6B).

A force required for relatively moving forward the pressing unit 40 with respect to the barrel 10 is a resultant force of a counterforce received by the pressing unit 41 from the front wall 31 of the rotation member 30, and an urging force by the coil spring 50. Until the moving unit 41 of the pressing unit 40 reaches the bulge 31*e* of the rotation member 30, the inclination of the front wall 31 of the rotation member 30 is constant. Thus, the counterforce received by the moving unit 41 from the front wall 31 of the rotation member 30 is substantially constant, irrespectively of the relative positional relationship between the rotation member 30 and the pressing unit 40. On the other hand, the urging force by the coil spring 50 increases at a constant rate as the pressing unit 40 relatively moves forward with respect to the barrel 10. Thus, the force required for relatively moving forward the pressing unit 40 with respect to the barrel 10 increases at a constant rate.

When the moving unit 41 of the pressing unit 40 has reached the bulge 31*e* of the rotation member 30, the inclination of the front wall 31 of the rotation member 30 becomes steeper with respect to the axis L (see FIG. 5). Thus, a ratio of a component of force that acts to relatively rotate the rotation member 30 with respect to the barrel 10 about the axis L, out of the force of the moving unit 40 that acts on the front wall 31 of the rotation member 30, decreases. In other words, it is necessary to act a larger pressing force on the pressing unit in order to continuously relatively rotate the rotation member 30 with respect to the barrel 10 about the axis L. Namely, when the moving unit 41 of the pressing unit 40 has reached the bulge 31*e* of the rotation member 30, a heavy operation feeling is provided to a user who presses the pressing unit 40.

Then, when the moving unit 41 of the pressing unit 40 has got over an apex of the bulge 31*e* of the rotation member 30, the inclination of the front wall 31 now becomes more gentle with respect to the axis L (see FIG. 5A). Thus, a ratio of the component of force that acts to relatively rotate the rotation member 30 with respect to the barrel 10 about the axis L, out of the force of the moving unit 40 that acts on the front wall 31 of the rotation member 30, increases. In other words, it is sufficient to act a smaller pressing force on the pressing unit 40 in order to continuously relatively rotate the rotation member 30 with respect to the barrel 10 about the axis L. Namely, when the moving unit 41 of the pressing unit 40 has got over the apex of the bulge 31*e* of the rotation member 30, a light operation feeling is provided to the user who presses the pressing unit 40. Thus, immediately before the moving unit 41 of the pressing unit 40 is positioned at the front end 33*sf* of the slit 33*s*, a click feeling is provided to the user. Further, during this operation, a quiet and smooth operation feeling is provided by the effect of the grease applied between the rotation member 30 and the inner shaft 11.

Due to the click feeling, the user can perceive that the writing body 20 has been relatively moved up to the frontmost point with respect to the barrel 10. Then, when the pressing force F acting on the pressing unit 40 is released, the writing body 20 is urged rearward with respect to the barrel 10 by the urging force of the coil spring 50. Thus, the moving unit 41 of the pressing unit 40 is relatively moved rearward with respect to the barrel 10 so as to bear against the rear wall 32 of the rotation member 30 (see FIG. 6C). At this time, when seen from behind, the detent portion 32*e* of the rotation member is located at a position advanced clockwise from the moving unit 41 about the axis L. As described above, since a part of the detent portion 32*e* and the vector that goes rearward along the axial direction da define the obtuse angle θ3 (see FIG. 5B), there is no possibility that the rotation member 30 is relatively rotated with respect to the barrel 10 about the axis L, even when the moving unit 41 presses rearward the rear wall 32 of the rotation member 30 by the urging force of the coil spring 50.

By means of the above operation, the operation for exposing the writing body 20 from the front end of the barrel 10 is completed. Then, the user grips the barrel 10 and moves the barrel 10 as desired for writing, while the pen point 21 is in contact with a paper sheet.

After the writing, when seen from behind, the user relatively rotates counterclockwise the head crown 34 with respect to the barrel 10. At this time, the rotation member 30 together with the head crown 34 is relatively rotated with respect to the barrel 10 about the axis L, so that the detent portion 32 of the rotation member 30 presses forward the moving unit 41 of the pressing unit 40 with respect to the barrel 10. Thus, while the writing body 20 compresses the coil spring 50, the moving unit 41 gets over the detent portion 32*e*. After the moving unit 41 has got over the detent portion 32*e*, the writing body 20 is relatively moved rearward with respect to the barrel 10 by the urging force of the coil spring 50 as a driving force, and the pressing unit 40 in contact with the writing body 20 is relatively moved rearward with respect to the barrel 10. Thus, it is not necessary for the user to relatively rotate the head crown 34 counterclockwise continuously. During the relative movement of the pressing unit 40 with respect to the barrel 10, the moving unit 41 relatively moves rearward with respect to the barrel 10 along the slot 12 of the inner shaft 11 (see FIG. 6D), while relatively rotating counterclockwise the rotation member 30 with respect to the barrel 10 when seen from behind. This relative movement continues until the moving unit 41 reaches the rear end 33*sr* of the slit 33*s*. Thus, the initial state shown in FIG. 6A is restored. Also in the relative rearward movement of the pressing unit 40 with respect to the barrel 10, a quiet and smooth operation feeling can be provided by the effect of the grease.

Note that, in the writing implement 100, the pen point 21 of the writing body 20 can be projected from the barrel 10, also by relatively rotating the head crown 34 with respect to the barrel 10 about the axis L. In this case, in the initial state shown in FIG. 6A, when seen from behind, by relatively rotating clockwise the head crown 34 about the axis L with respect to the barrel 10, the moving unit 41 moves forward in the slot 12 of the inner tube 11, by a force received from the rear wall 32 of the rotation member 30. Thus, the writing body 20 relatively moves forward with respect to the barrel 10 while compressing the coil spring 50, so that the pen point 21 is gradually exposed from the barrel 10. In this manner, when the writing body 20 is exposed from the front end of the barrel 10 by the rotational operation of the head crown 34, the rear wall 32 of the rotation member 30 presses the moving unit 41. Thus, in this case, differently from the aforementioned pressing operation of the pressing unit 40, the interaction between the front wall 31 of the rotation member 30 and the moving unit 41 does not occur.

Then, immediately before the moving unit 41 of the pressing unit 40 reaches the front end 33*sf* of the slit 33*s* of the rotation member 30, the moving unit 41 gets over the detent portion 32*e*. Thus, as described above, there is no possibility that the moving unit 41 relatively moves rearward with respect to the barrel 10, even when the moving unit 41 presses rearward the rear wall 32 of the rotation member 30 by the urging force of the coil spring 50. Namely, the state in which the pen point 21 of the writing body 20 is exposed from the barrel 10 can be stably maintained. Since a procedure for retracting the pen point 21 of the writing body 20 into the barrel 10 after writing is the same as the procedure described with reference to FIGS. 6C and 6D, description thereof is omitted here.

According to the aforementioned writing implement 100, by pressing forward the pressing unit 40 with respect to the barrel 10, the pen point 21 of the writing body 20 is exposed from the barrel 10, while the rotation member 30 is relatively rotated with respect to the barrel 10 about the axis L smoothly. Namely, according to the present invention, since the writing body 20 can be quietly and smoothly projected from and retracted into the barrel 10 by a simple one-hand operation, the writing implement 100 excellent in both operability and operation feeling can be provided.

In addition, the rotation member 30 can be rotated outside from the barrel 10 through the head crown 34. Thus, by relatively rotating the rotation member 30 with respect to the barrel 10 about the axis L, the moving unit 41 of the pressing unit 40 is relatively moved with respect to the barrel 10 in the axial direction da. By pressing forward the pressing unit 40 with respect to the barrel 10, the rotation member 30 is relatively rotated with respect to the barrel 10 about the axis L. Thus, either by means of the forward pressing operation of the pressing unit 40 with respect to the barrel 10, or by the rotational operation of the rotation member 30 about the axis L through the head crown 34, the pen point 21 of the writing body 20 can be exposed from the barrel 10.

Further, the rotation member 30 has the front wall 31 and the rear wall 32 which extend opposite to each other so as to define the slit 33*s*, and the front wall 31 has the bulge 31*e*, which bulges rearward, near the front end 33*sf* of the slit 33*s*. Thus, when the operation for pushing forward the pressing unit 40 with respect to the barrel 10 so as to expose the pen point 21 of the writing body 20 from the barrel 10 is completed, a suitable click feeling can be provided to a user.

Next, a modification example of the writing implement 100 of FIG. 1 is described.

Figure 7:
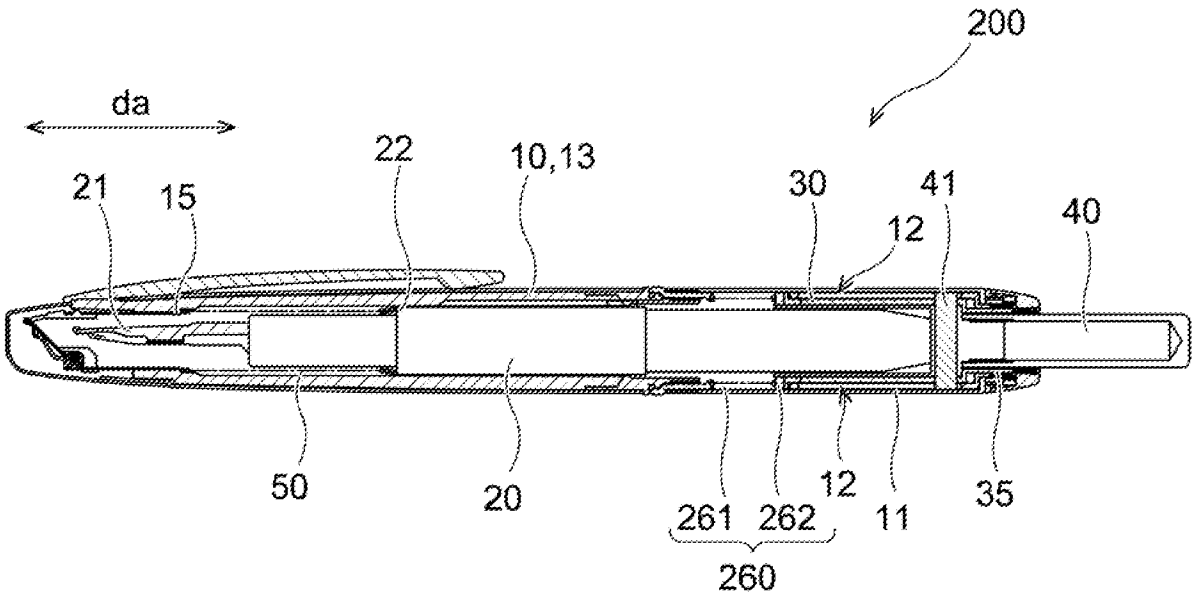
FIG. 7 is a schematic longitudinal sectional view of a writing implement according to a modification example of FIG. 1, showing a state in which a writing body is retracted in a barrel.
Figure 8:
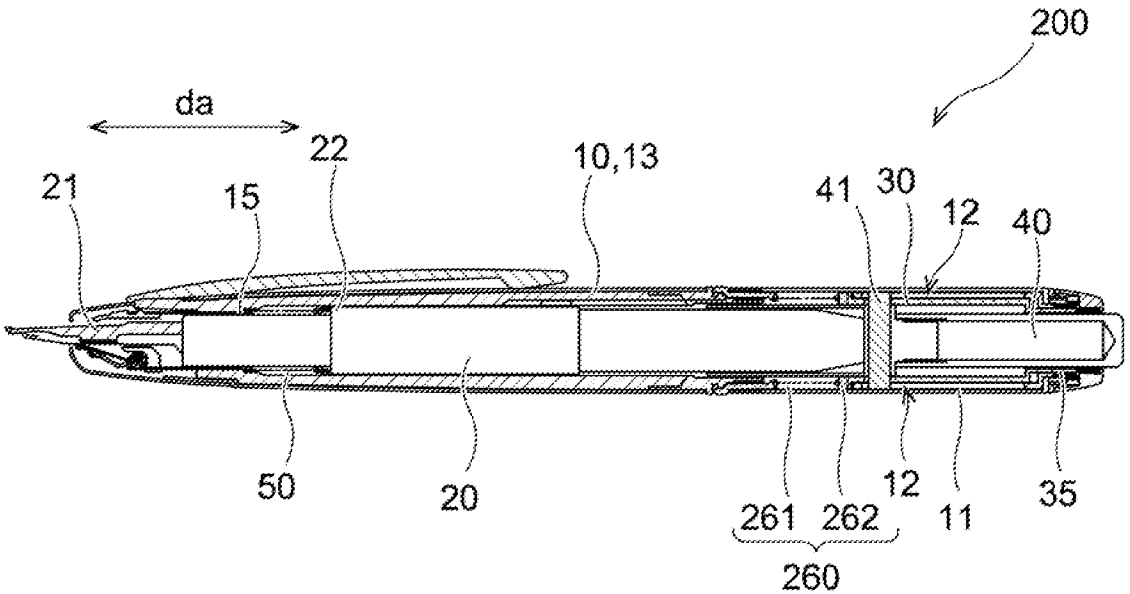
FIG. 8 is a schematic longitudinal sectional view of the writing implement according to the modification example of FIG. 1, showing a state in which the writing body is projected from the barrel.

FIGS. 7 and 8 are schematic longitudinal sectional views showing a writing implement 200 according to a modification example of FIG. 1. FIG. 7 shows a state in which the writing body 20 is retracted in the barrel 10, and FIG. 8 shows a state in which the writing body 20 is projected from the barrel 10.

As shown in FIG. 7, the writing implement 200 differs from the writing implement 100 shown in FIG. 1 in that it further comprises a braking unit 260 that decelerates a rotation speed of the rotation member 30 when the rotation member 30 relatively rotates with respect to the barrel 10 about the axis L. The braking unit 260 has a contact member 262 that is in contact with the rotation member 30, and urging means 261 that urges the contact member 262 with respect to the barrel 10 in the axial direction da so as to bear the contact member 262 against the rotation member 30. A relative rotation of the contact member 262 with respect to the barrel 10 about the axis L is restricted. In the example shown in FIG. 7, the urging means 261 is disposed in a compressed state between the barrel 10 (barrel body 13) and the contact member 262. Namely, the urging means 261 is disposed in front of the rotation member 30 so as to bear the contact member 262 against the rotation member 30 from the front side. The remaining structure is substantially the same as that of the writing implement 100 shown in FIG. 1. Thus, in FIGS. 7 and 8, the same symbol is given to a constituent element common to that of the writing implement 100 of FIG. 1, and detailed description thereof is omitted.

In such a writing implement 200, a main operation for projecting/retracting the writing body 20 from/into the barrel 10 is common to the operation of the writing implement 100 described with reference to FIGS. 6A to 6D. However, in the writing implement 200, a rotation speed of the relative rotation of the rotation member 30 with respect to the barrel 10 about the axis L is decelerated by a frictional force acting on a contact part between the rotation member 30 and the contact member 262. Namely, upon completion of writing with the writing implement 200, when the head crown 34 is relatively rotated counterclockwise seen from behind by a user with respect to the barrel 10, the rotation member 30 is relatively rotated with respect to the barrel 10 about the axis L, in accordance with the relative rotation. When the moving unit 41 of the pressing unit 40 has got over the detent portion 32*e* of the rotation member 30, as described above, the writing body 20 is relatively moved rearward with respect to the barrel 10 by the urging force of the coil spring 50. Thus, the pressing unit 40 in contact with the writing body 20 relatively moves rearward with respect to the barrel 10, while relatively rotating the rotation member 30 with respect to the barrel 10 about the axis L. During this relative movement, due to the presence of the braking unit 260, the rotation member 30 and the head crown 34 attached to the rear end portion 35 of the rotation member 30 are relatively rotated with respect to the barrel 10 about the axis L comparatively slowly. Thus, the pressing unit 40 returns to the initial state shown in FIG. 7 comparatively slowly.

According to the aforementioned writing implement 200, in addition to the same effect as that of the writing implement 100, when the writing body 20 is projected from and retracted into the barrel 10, a more quiet and smooth operation feeling than that of the writing implement 100 can be provided due to the presence of the braking unit 260. Further, when the writing body 20 is projected from and retracted into the barrel 10, in particular, when the writing body 20 is retracted into the barrel 10 so that the moving unit 41 comes into contact with the rear end 33*sr* of the slit 33*s*, it can be effectively prevented that the writing body may experience a large impact, whereby risk in which ink spatters from the pen point 21 can be reduced.

In addition, when the writing body 20 is retracted into the barrel 10, a projecting motion of the pressing unit 40 is carried out at the rear end of the barrel 10, correspondingly to the retracting motion of the pen point 21 performed in front of the barrel 10. The projecting motion is performed at a low speed due to the presence of the braking unit 260. In accordance therewith, the head crown 34 disposed behind the barrel 10 is rotated slowly. Thus, the motions of the both members can be easily perceived visually, so that a user can easily feel a functional character. Further, an outer circumferential surface of the head crown 34 exposed from the barrel 10 may be subjected to a knurling process or a diamond-cutting process. In this case, during the operation (rotation) of the crown head 34, an ornamental effect can be obtained by the crown head 34 that reflects light in various directions. In addition, such a process also serves as non-slip means, the rotational operation is facilitated. Moreover, even when the grease applied between the pressing unit 40 and the rotation member 30 and between the rotation member 30 and the inner tube 11 deteriorates because of long-term use, a quiet and smooth operation feeling can be maintained. In addition, even in a case where no grease is applied, a quiet and smooth operation can be provided.

In addition, the braking unit 260 has the contact member 262 that is in contact with the rotation member 30, and the urging means 261 that urges the contact member 262 with respect to the barrel 10 in the axial direction da so as to bear the contact member 262 against the rotation member 30. Thus, since the contact member 262 bears against the rotation member 30 at a constant pressing force, the rotation member 30 can stably receive a constant frictional force.

Furthermore, in the writing implement 200, since the urging means 261 is disposed in front of the rotation member 30 so as to bear the contact member 262 against the rotation member 30 from the front side, a space for the braking unit 260 can be ensured more easily in front of the rotation member 30 than behind thereof, whereby a degree of freedom in design of the braking unit 260 is high. That is to say, a material of the contact member 262 and a spring constant of the urging means 261, which determine a frictional force acting on the rotation member 30, can be easily set as desired.

Note that the braking unit 260 may be disposed behind the rotation member 30. Namely, the urging means 261 may be disposed behind the rotation member 30 so as to bear the contact member 262 against the rotation member 30 from the rear side. Also in this case, the same effect can be achieved. In addition, the braking unit 260 may be disposed laterally to the rotation member 30. Namely, the urging means 261 may be disposed laterally to the rotation member 30 so as to bear the contact member 262 against the rotation member 30 from the lateral side. Further, the braking unit 260 is not limited to the combination of the urging means 261 and the contact member 262. For example, a member such as an O-ring made of rubber or elastomer, which can provide a desired frictional force, may be employed, and such a member may be disposed in a clearance between the barrel 10 and the rotation member 30.

In addition, in the above description, the example of the writing implement 100 or 200 in which the slits 33*s* are formed by the front wall 31 and the rear wall 32 of the rotation member 30 is described. However, as long as the moving unit 41 can be guided, grooves or the like may be formed instead of the slits 33*s*. Also in this case, the rotation member 30 can be relatively rotated with respect to the barrel 10 about the axis L suitably, by the moving unit 41 of the pressing unit 40.

In addition, in the above description, the example in which the pressing unit 40 is projected rearward from the rear end of the barrel 10. However, another example is possible in which a clip (not shown) disposed on a lateral surface of the barrel 10 (inner shaft 11) functions as a pressing unit as a so-called clip slide type. Alternatively, the writing implement may be of a side knock type in which an operation unit capable of being pushed in the radial direction of the barrel 10 is provided on the side surface of the barrel 10. In this case, a suitable mechanism that converts a pushing force of the operation unit in the radial direction of the barrel 10 to a force in the axial direction da of the barrel 10 is employed.

What is claimed is:

1. A writing implement comprising:

a barrel;

a writing body supported by the barrel so as to be relatively movable with respect to the barrel in an axial direction thereof, whereby the writing body is projected from and retracted into a front end of the barrel;

a rotation member disposed in the barrel so as to be relatively rotatable with respect to the barrel about an axis thereof, the rotation member being provided with a groove or a slit that helically extends about the axis;

a pressing unit having a moving unit that moves in the groove or the slit, the pressing unit being relatively movable with respect to the barrel in the axial direction, while relative rotation about the axis being restricted; and a braking unit having a contact member that is in contact with the rotation member, and an elastic member that urges the contact member with respect to the barrel in the axial direction so as to bear the contact member against the rotation member, wherein the pressing unit can be pressed with respect to the barrel, from outside the barrel.

2. The writing implement according to claim 1, wherein:

the rotation member can be rotated from outside the barrel;

when the rotation member is relatively rotated with respect to the barrel about the axis, the moving unit of the pressing unit is relatively moved with respect to the barrel in the axial direction; and when the pressing unit is pressed forward with respect to the barrel, the rotation member is relatively rotated with respect to the barrel about the axis.

3. The writing implement according to claim 1, wherein the braking unit decelerates a rotation speed of the rotation member when the rotation member relatively rotates with respect to the barrel about the axis.

4. The writing implement according to claim 1, wherein the elastic member is disposed in front of the rotation member so as to bear the contact member against the rotation member from the front side.

5. The writing implement according to claim 1, wherein:

the rotation member has a front wall and a rear wall which extend opposite to each other so as to define the groove or the slit; and the front wall has a bulge, which bulges rearward, near a front end of the groove or the slit.

* * * * *